United States Patent [19]

Swanson

[11] Patent Number: 4,557,782

[45] Date of Patent: Dec. 10, 1985

[54] METHODS OF SECURING AN ADHESIVE STRIP TO A CARRIER

[75] Inventor: Robert R. Swanson, Clemmons, N.C.

[73] Assignee: AT&T Technologies, Inc., Berkeley Heights, N.J.

[21] Appl. No.: 550,699

[22] Filed: Nov. 10, 1983

[51] Int. Cl.[4] ..... B32B 31/18

[52] U.S. Cl. ..... 156/250; 156/253; 156/261; 206/330

[58] Field of Search ..... 156/91, 92, 196, 210, 156/220, 221, 222, 250, 252, 253, 268, 290, 296, 298, 299, 300, 303.1; 206/330, 331; 53/509, 543, 555, 412, 450, 138 R, 139, 410, 416, 435, 461, 462, 466

[56] References Cited

U.S. PATENT DOCUMENTS

| | | | |
|---|---|---|---|
| 2,621,432 | 12/1952 | Willner | 156/306.3 |
| 2,757,792 | 8/1956 | Shioleno | 206/330 |
| 2,766,510 | 10/1956 | Heibel | 29/25.42 |
| 2,815,124 | 12/1957 | Pellier | 206/330 |
| 2,929,130 | 3/1960 | Packman | 29/25.42 |
| 3,048,268 | 8/1962 | Rocchi et al. | 206/329 |
| 3,051,361 | 8/1962 | Menkel | 226/6 |
| 3,086,652 | 4/1963 | Lipscomb | 206/331 |
| 3,135,375 | 6/1964 | Henn et al. | 198/648 |
| 3,166,838 | 1/1965 | Goldsworthy | 156/253 |
| 3,215,168 | 11/1965 | Dian et al. | 140/71 R |
| 3,231,082 | 1/1966 | Weiss | 206/329 |
| 3,361,251 | 1/1968 | Olsson | 206/330 |
| 3,398,768 | 8/1968 | Van Hoof | 140/147 |
| 3,465,874 | 9/1969 | Hugle et al. | 206/330 |
| 3,650,706 | 3/1972 | Parsons | 428/51 |
| 3,793,928 | 2/1974 | Wootten | 493/350 |
| 4,049,118 | 9/1977 | Honda et al. | 206/330 |
| 4,077,439 | 3/1978 | Hamuro et al. | 140/1 |
| 4,108,305 | 8/1978 | Komatu | 206/330 |
| 4,192,061 | 3/1980 | Masuzima et al. | 29/854 |
| 4,243,139 | 1/1981 | Masujims et al. | 206/330 |
| 4,274,902 | 6/1981 | Jenkins | 156/253 |
| 4,325,771 | 4/1982 | Brower | 156/261 |

FOREIGN PATENT DOCUMENTS

| | | |
|---|---|---|
| 807622 | 6/1942 | Fed. Rep. of Germany . |
| 2752202 | 9/1977 | Fed. Rep. of Germany . |

*Primary Examiner*—Caleb Weston

*Attorney, Agent, or Firm*—S. I. Rosen

[57] ABSTRACT

A plurality of pins (14) are placed on a carrier (12) in a spaced, parallel arrangement and held in place by an adhesive-backed strip (13). Thereafter tabs (39) are formed in the strip (13) and are pressed into pockets (41) of the carrier (12) as the pockets are being formed. This enhances the securance of the strip (13) with the carrier (12) and holds the pins (14) in the spaced, parallel arrangement.

4 Claims, 6 Drawing Figures

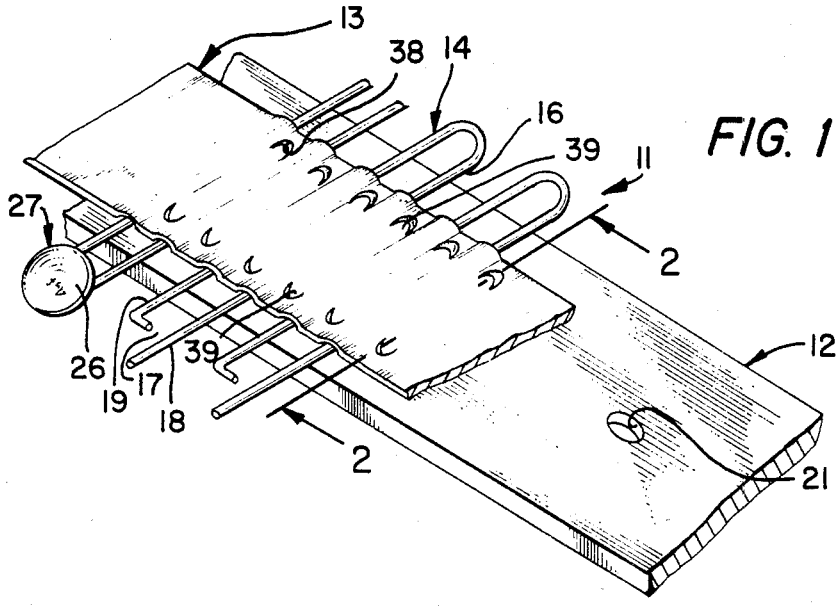
FIG. 1
FIG. 2
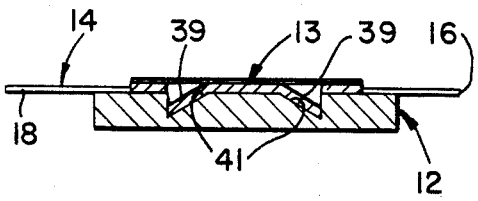
FIG. 3
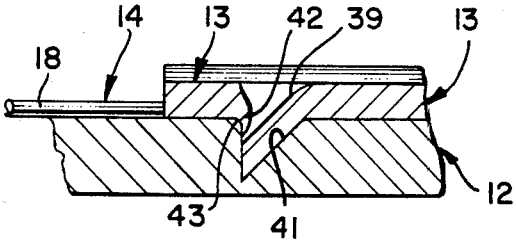

METHODS OF SECURING AN ADHESIVE STRIP TO A CARRIER

TECHNICAL FIELD

This invention relates to methods of securing an adhesive strip to a carrier. In particular, this invention relates to methods of enhancing the securance of the strip to the carrier to preclude undesired and premature separation of the strip from the carrier.

BACKGROUND OF THE INVENTION

In the manufacture of some radial-lead electrical components, a plurality of looped pins are formed from a continuous length of small guage wire. Each pin is formed with a closed end and an open end at opposite extremeties of the pin and with parallel legs extending from the closed end to the open end in a hair-pin-like configuration. The formed pins are positioned in a spaced, parallel arrangement on a cardboard strip-like carrier with the opposite ends of each pin extending beyond opposite side edges of the carrier. An adhesive strip is then placed over intermediate portions of the pins and onto underlying portions of the carrier whereby the strip is adhesively secured to the carrier. A pin-carrier assembly is thus formed whereby the pins are retained with the carrier in the spaced, parallel arrangement.

A machine for manufacturing such a pin-carrier assembly is commercially available from Die-Craft Metal Products, Inc. of Des Plaines, Ill. as the Model 14.

The pin-carrier assembly is then processed through a series of stations whereat an electrical component body, such as a tantalum capacitor body, is attached about the open end of each of the pins. Thereafter, the extreme end portions of the closed end of each pin are severed from the remainder of the pin whereby the parallel legs of each pin are now separated and extend in free fashion from the formed component body as radial leads thereof to thereby form an electrical component. The individual components remain secured to the carrier by the adhesive strip and can now be transported for ultimate soldering, epoxy coating, testing, marking and packaging leading to ultimate individual assembly with an electrical circuit.

While the above-described process for manufacturing the pin-carrier assemblies has been generally successful, at unpredictable times, the adhesive strip has a tendency to become dislodged from the carrier thereby permitting the pins, or the ultimately formed radial lead components, to skew and disorient from the remaining pins. This is particularly so where the bodies of the components are of a heavier weight or where the pins or leads are spaced closer together which reduces the adhesion-to-carrier area. Efforts to improve the adhesive quality of the strip have not resolved the problem.

When a disoriented pin on a pin-carrier assembly is detected, it is in one of the final component manufacturing stations. When a single pin becomes disoriented, including an assembly with a component body, the deleterious results are cascading whereby trailing assemblies are also affected due to the loss of component positioning. This creates defective product which necessitates costly down-time in the manufacture of the components and loss of the resulting defective products.

Consequently in order to obtain full utilization of the pin-carrier assemblies, a technique must be found to enhance the securance of the adhesive strip with the carrier to retain the pins, and the pins with the component bodies, in the desired spaced, parallel arrangement.

SUMMARY OF THE INVENTION

This invention contemplates methods of securing a strip having an adhesive surface to a carrier formed from a compressible material. Initially, the adhesive surface of the strip is placed into engagement with a surface of the carrier. The strip is then pressed toward the carrier to secure the strip with the carrier. Thereafter, at least one selected portion of the strip is pressed more firmly into engagement with the carrier.

This invention further contemplates an assembly which includes a carrier having at least one pocket formed therein. An adhesive surface of a strip is located in securing engagement with a surface of the carrier with a portion of the adhesive surface being in securing engagement with the pocket.

BRIEF DESCRIPTION OF THE DRAWINGS

FIG. 1 is a perspective view, showing an adhesive strip secured to a carrier to form a pin-carrier assembly in accordance with certain principles of the invention;

FIG. 2 is a cross-sectional view taken along line 2—2 of FIG. 1 showing the strip secured to the carrier in accordance with certain principles of the invention;

FIG. 3 is an enlarged view of a portion of FIG. 2 showing enhanced securance of the strip to the carrier in accordance with certain principles of the invention;

DETAILED DESCRIPTION

Figure 4:
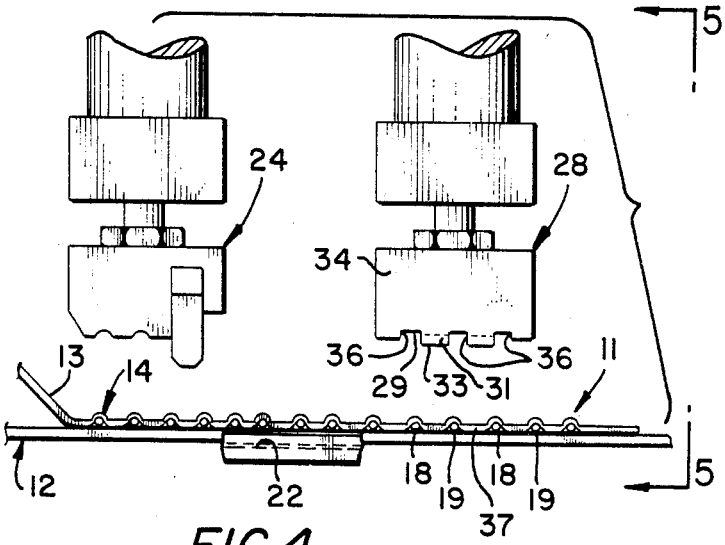
FIG. 4 is a front view showing the pin-carrier assembly of FIG. 1 being formed in accordance with certain principles of the invention.

Referring to FIG. 1, a pin-carrier assembly, designated generally by the numberal 11, includes a carrier 12, formed from a compressible, porous material such as cardboard, and an adhesive strip 13 having adhesive on at least one surface thereof. The pin-carrier assembly 11 also includes a plurality of hair-pin-like pins, designated generally by the numeral 14, which are formed with a closed end 16, an open end 17 and a pair of parallel legs 18 and 19 extending between the closed and open ends.

The pin-carrier assembly 11 may be formed by the aforementioned machine (not shown) which is available from Die-Craft Metal Products, Inc., as their Model No. 14.

Initially, a plurality of carriers 12 are placed in a vertical stack in a magazine (not shown). The lowermost carrier 12 is fed horizontally from the magazine and feed holes 21 (one shown) are punched into spaced locations of the carrier. The carrier 12 is then moved to a position whereat a chain drive mechanism (not shown) engages the holes 21 to move the carrier over a pair of spaced support ledges 22 and 23 (FIG. 5) and along an assembly line adjacent to a series of stations for formation of the pin-carrier assembly 11. The hair-pin-like pins 14 are formed by the machine and are positioned on the carrier 12 in the spaced, parallel alignment as illustrated in FIG. 1. Thereafter, the carrier 12 and positioned pins 14 are moved beneath a continuous length of the adhesive strip 13 which is being fed from a supply roll (not shown).

The carrier 12 with positioned pins 14 is indexed along the assembly line to locate successive pairs of the pins beneath a strip applicator tool 24 (FIG. 4) which is a part of the machine available from Die-Craft Metal Products, Inc. As tool 24 is lowered, the adhesive strip 13 is engaged and the adhesive surface of the strip is pressed into securing engagement with the carrier 12 and the positioned pair of pins 14 whereby adhesive material on the strip as well as portions of the strip are forced into pores of the carrier to facilitate securance of the pins with the carrier. Ultimately, a given number of pins 14 are secured to the carrier 12 by the adhesive strip 13. The portion of the strip 13 which is secured to the carrier 12 is then severed from the supply as a final step in the manufacture of the pin-carrier assembly 11.

The pin-carrier assembly 11 is then removed from the machine and is later processed through a series of stations (not shown) whereat an electrical component body 26 (FIG. 1), such as a tantalum capacitor, is attached about the open ends 17 of the pins 14. The closed ends 16 are then severed from the parallel legs 18 and 19 to provide an electrical component, designated generally by the numeral 27, having radial leads formed by the parallel legs. The now-formed electrical components 27 are retained with the carrier 12 by the strip 13 to facilitate transportation of the components through a series of stations (not shown) for soldering, epoxy coating, testing, marking and packaging.

A variety of codes of components 27 are manufactured using this technique with some of the codes having component bodies 26 of relatively heavier weight.

Generally, the pins 14 are maintained in the spaced parallel alignment on the carrier 12 during attachment of the component body 26 whereafter the components 27 remain in place on the carrier during subsequent processing. However, during processing of the pin-carrier assembly 11 and subsequent processing of the components 27, the components having heavier bodies 26, or assemblies where the pins 14 are closer together, cause the adhesive strip 13 to be pulled away from the carrier 12. This then causes the pins 14 or the components 27 to become dislodged from the carrier 12 and become disoriented from adjacent pins or components. As the pin-carrier assembly 11 with disoriented pins 14, or the carrier 12 with similarly disoriented components 27, is processed through subsequent stations, malfunctions occur in the manufacture of the components. This results in time-consuming and costly down-time in the manufacturing process and loss of product.

Figure 6:
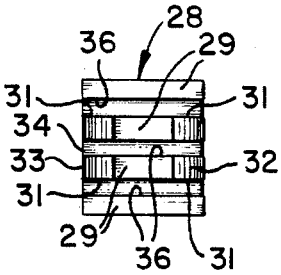
FIG. 6 is a bottom view taken along line 6—6 of FIG. 5 showing the underside of the dink tool of FIG. 5.
Figure 5:
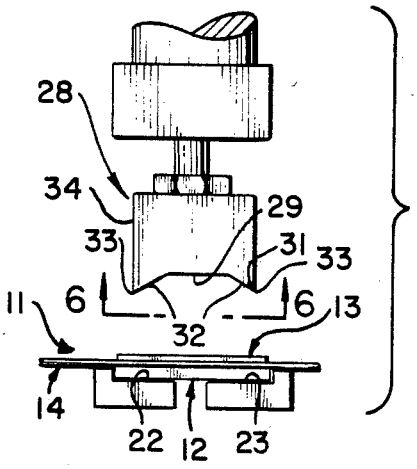
FIG. 5 is a side view taken along line 5—5 of FIG. 4 with carrier support ledges added and showing a dink tool for forming depressed pockets in the carrier and for pressing the strip into the pockets in accordance with certain principles of the invention.

Referring to FIG. 4, in order to overcome this problem, the pin-carrier assembly 11 is processed through another station, which includes a dink tool, designated generally by the numeral 28, during formation of the pin-carrier assembly. Referring to FIGS. 4, 5 and 6, the dink tool 28 is formed on an undersurface 29 thereof with four dink-forming ramps 31. Each dink-forming ramp 31 is formed by a sloping surface 32 which begins at an inner portion of the undersurface 29, projects outwardly from the undersurface and terminates at a cutting edge 33 (FIG. 4) which is coincidental with a contiguous side surface 34 of the dink tool 28. In addition, three spaced, parallel wire-receiving slots 36 are formed in the undersurface 29 as illustrated in FIG. 5.

Referring to FIG. 4, after the adhesive strip 13 has been pressed into engagement with the carrier 12 and the pins 14 by applicator tool 24, the carrier is indexed to locate a carrier segment directly beneath the dink tool 28 in preparation for a dinking operation. As the carrier segment is supported on the spaced ledges 22 and 23 (FIG. 5), the dink tool 28 is lowered whereby three parallel legs, for example legs 18 and 19 of one pin 14 and leg 18 of the adjacent pin, are positioned within the slots 36 of the dink tool to permit the cutting edges 33 and the dink-forming ramps 31 to engage the strip 13. Upon continuous downward movement, the cutting edges 33 engage and dink the adhesive strip 13 at four locations between and adjacent to the pins 14 by forming arcuate cuts and associated tabs 39 in the strip as illustrated in FIGS. 1 and 2. The tabs 39 are defined by the arcuate cuts and hinge-like portions which remain integrally formed with the remainder of the strip 13. As the dink tool 28 continues downwardly, sloping depressions or pockets 41 (FIGS. 1, 2 and 3) are formed in, but not through, the underlying portions of the carrier 12 by the sloping surfaces 32 of the ramps 31. As the sloping pockets 42 are formed, the tabs 39 of the strips 13 are pressed more firmly by the sloping surfaces 32 further onto the surfaces of the pockets.

By use of the ramps 31, the cutting edges 33 facilitate formation of the tabs 39 while the sloping surfaces 32 permit the formation of the pockets 41 without cutting the tabs any further. Thus, the tabs 39 remain integrally formed with the remainder of the strip 13.

Since the adhesive strip 13 has been secured to the carrier 12 before the dinking operation, the adhesive surfaces of the tabs 39 are pressed further into the surfaces of the pockets 41 as the pockets are being formed. The pressure applied to the carrier 12 to form the pockets 41 tends to compact the portions of the carrier which form the surfaces of the pockets thereby closing the pores of the pocket surfaces. As the surfaces of the pockets 41 are being compacted, it appears that the adhesive on the surfaces of the tabs 39 as well as portions of the tabs are further compressed within the closing pores of the surfaces of the pockets. This further enhances securance of the strip 13 with the carrier 12.

Referring to FIG. 3, it also appears that, as the cutting edges 33 cut through the strip 13 and partially into the carrier 12, each of the cutting edges pulls and stretches a small portion 42 of the strip over a corner 43 of the carrier just formed by the dinking operation. The strip portions 42 are thereby firmly pressed against side walls 44 of the pockets 41 to create additional shear force along with the standard feel force and thereby provide further enhancement of the securance of the strip 13 with the carrier 12.

Thus, by forming the tabs 39 in the strip 13 and by forming the pockets 41 in the carrier 12 with the tabs and strip portions 42 firmly secured within the pockets, the securance of the strip with the carrier is enhanced. This enhancement provides for substantially trouble-free formation of the pin-carrier assembly 11 with the pins 14 being retained in the spaced, parallel arrangement and the manufacture and subsequent handling of the components 27 while being retained in the spaced, parallel arrangement on the carrier 12.

What is claimed is:

1. A method of producing an article-carrier assembly which includes a strip having an adhesive surface, a carrier formed from a compressible material and at least one article, which comprises the sequential steps of:

placing the article onto one surface of the carrier:

placing the adhesive surface of the strip into engagement with at least a portion of the article and one surface of the carrier:

pressing the strip toward the carrier to secure the strip with the carrier with the article there between:

forming at least one tab in a selected portion of the strip adjacent to the article:

forming at least one pocket in a selected portion of the compressible carrier; and pressing the tab into the pocket.

2. The method as set forth in claim 1 wherein each of the tabs are pressed into a base of the pocket and which further comprises the step of pressing another portion of the strip into a side wall of the pocket.

3. The method as defined in claim 1, wherein said tab is pressed into the pocket as the pocket is formed.

4. The method as defined in claim 1 wherein said tab is formed by making an arcuate cut through a selected portion of the strip whereby each tab is defined by said arcuate cut and a hinge portion which is formed integrally with the remainder of the strip.

* * * * *